United States Patent [19]

Kuenzel

[11] 4,124,245

[45] Nov. 7, 1978

[54] WELL TOOL

[76] Inventor: Rainer Kuenzel, #2 Gessner Rd., Houston, Tex. 77024

[21] Appl. No.: 741,036

[22] Filed: Nov. 11, 1976

[51] Int. Cl.[2] ..... E21B 31/02

[52] U.S. Cl. ..... 294/86.3; 166/99

[58] Field of Search ..... 294/86.3, 86.31, 86.32, 294/86.33, 86.28, 86.26, 86.25, 86.24, 86.18, 86.15, 86.14, 86.1, 115, 116; 166/98, 99, 137, 215, 217

[56] References Cited

U.S. PATENT DOCUMENTS

| | | | |
|---|---|---|---|
| 2,743,130 | 4/1956 | Osman | 294/86.3 |
| 3,321,016 | 5/1967 | Lance | 166/99 |

*Primary Examiner*—James B. Marbert

*Attorney, Agent, or Firm*—Browning, Bushman & Zamecki

[57] ABSTRACT

A well tool of the type comprising a plurality of radially extendable and retractable gripping elements and deflecting means for radially moving the gripping elements by longitudinal movement with respect thereto. The tool comprises a camming mechanism for converting longitudinal motion to rotary motion in discreet increments for aligning and offsetting stop surfaces on the tool. The camming mechanism is characterized in that the engageable camming surfaces on each of two relatively movable members of the camming mechanism extend longitudinally and circumferentially.

28 Claims, 18 Drawing Figures

WELL TOOL

BACKGROUND OF THE INVENTION

1. Field of the Invention

The present invention pertains to well tools for retrieving objects from wells. Such tools may be generally referred to as "fishing tools" and the objects to be retrieved as "fish." One particular type of fishing tool to which the invention may be applied is an overshot. Such a tool comprises a plurality of radially movable grapple fingers which may be lowered around the fish, typically a piece of drill pipe or the like, and then contracted inwardly to grip the fish by a surrounding bowl having deflecting surfaces. Another particular type of tool in which the present invention may be incorporated is a spear having similar radial movable slips which may be lowered into a fish, such as a length of casing, and then expanded outwardly to grip the fish by an expander also having deflecting surfaces.

2. Description of the Prior Art

In a prior art fishing tool, the radial movements which are permitted the gripping elements are controlled by relative longitudinal movements of a pair of telescoping assemblies, one of which carries the gripping elements and the other of which carries the deflecting means. Stop surfaces limit these relative movements but can be offset by relative rotation of the assemblies to permit the longitudinal movements. A camming arrangement is provided to selectively align or offset the stop surfaces by converting longitudinal movements of the two assemblies into rotational motion. However, in this tool, the stop surfaces as well as the camming surfaces on at least one of the assemblies are defined by pins or studs which essentially provide only point contact with the corresponding surfaces on the other assembly and which are highly susceptible to shearing and other damage as they strike these surfaces during operation.

SUMMARY OF THE INVENTION

In the fishing tool of the present invention, a camming assembly is provided in which at least some of the camming surfaces on each member extend both circumferentially and longitudinally providing a relatively large surface area for contact. Furthermore in the preferred embodiments, these surfaces are provided by the end surfaces of one of the cam members and by radially upset portions of substantial extent on the other cam member. These features together substantially eliminate the possibility of shearing off of the surface-defining portions under the force of the blows which are delivered to the surfaces in the longitudinal direction during operation.

Certain of the camming surfaces may also partially define the stop surfaces of the tool whereby shearing or other damage to these surfaces is also eliminated.

While the unique camming and stop surfaces of the present invention provide substantial advantages over those of the prior art, they do not substantially increase the cost of production.

The invention may be applied to various types of fishing tools including overshots and spears. Furthermore, the camming mechanism itself constitutes a novel mechanism which may be employed in numerous environments in which it is necessary to convert longitudinal motion to rotational motion in descreet steps.

Accordingly, it is a principal object of the present invention to provide an improved fishing tool.

Another object of the invention is to provide a fishing tool having a camming mechanism in which each of two members includes longitudinally and circumferentially extending camming surfaces.

Still another object of the present invention is to provide a fishing tool having improved stop surfaces.

Yet a further object of the present invention is to substantially increase the durability and reliability of a fishing tool without proportional increases in production costs.

Still another object of the present invention is to provide an improved camming mechanism for converting longitudinal motion to rotational motion in discreet steps.

Other objects, features, and advantages of the present invention will be made apparent by the following description of the preferred embodiments, the drawings, and the claims.

DESCRIPTION OF THE PREFERRED EMBODIMENTS

Figure 1A:
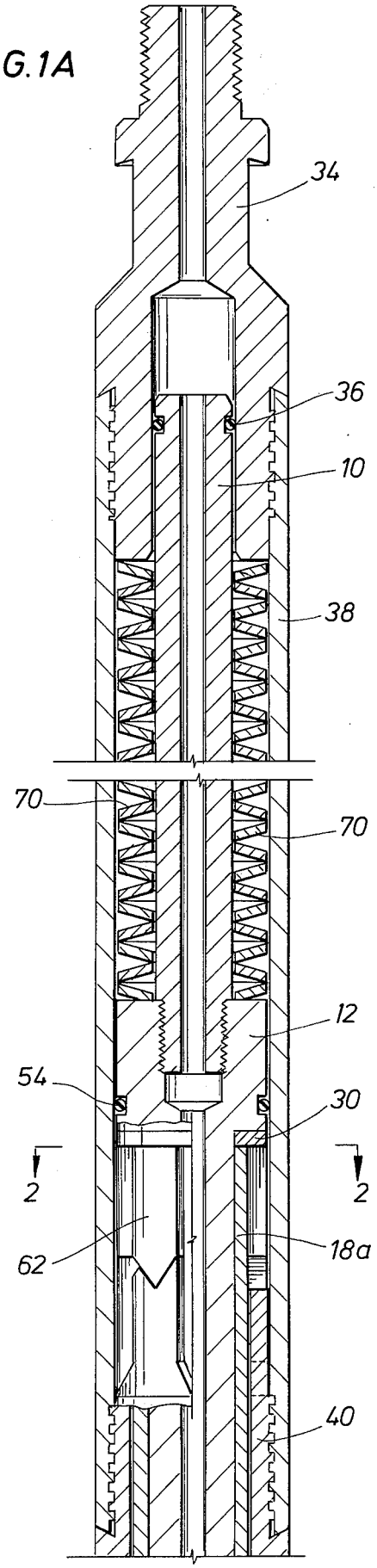
FIG. 1A is a longitudinal cross-sectional view, with parts shown in elevation, of the upper portion of an overshot in accord with the present invention in release position.
Figure 1B:
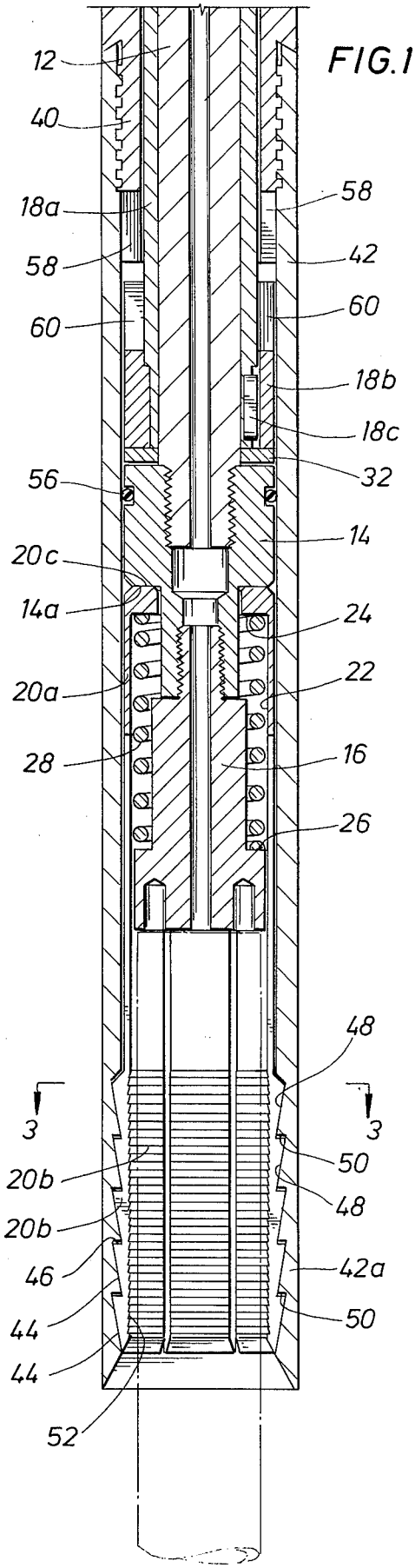
FIG. 1B is a view similar to that of FIG. 1A of the lower portion of the overshot.
Figure 2:
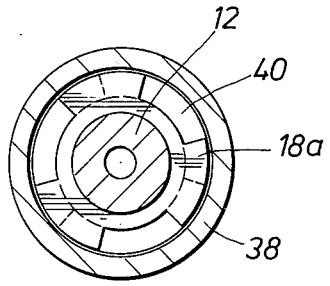
FIG. 2 is a transverse cross-sectional view on lines 2—2 of FIG. 1A.
Figure 3:
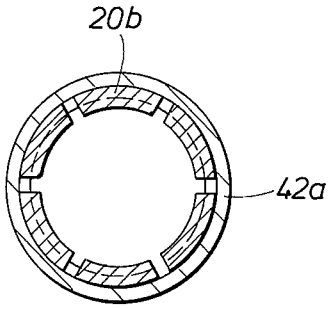
FIG. 3 is a transverse cross-sectional view on lines 3—3 of FIG. 1B.

Referring now to FIGS. 1A and 1B there is shown an overshot comprising first and second elongate assemblies connected for relative telescopic movement. The first assembly, in this case the inner assembly, comprises a washpipe 10 the lower end of which is connected to a mandrel 12. Mandrel 12 has an upper portion of enlarged diameter and a lower portion of reduced diameter. A sub 14 has a large diameter upper portion threadedly connected to the lower end of mandrel 12 and a smaller diameter lower portion threadedly connected to a carrier member 16, the latter also serving as a fish locator. The first assembly also comprises a first cam member surrounding the reduced diameter portion of mandrel 12. The first cam member comprises a main body portion 18*a* and a shorter annular portion 18*b* secured about the lower end of portion 18*a* by a key 18*c*.

An annular spacer 30 is tightly disposed between the upper end of portion 18*a* of the first cam member and the annular shoulder formed between the large and small diameter portions of mandrel 12. A similar spacer 32 is fitted between the upper end of sub 14 and the lower ends of cam member portions 18*a* and 18*b*.

Gripping means in the form of a grapple is carried by the first elongate assembly. The grapple includes an upper sleeve 20*a* generally surrounding the lower portion of sub 14 and the carrier member 16, and a plurality of grapple fingers 20*b* integral with the sleeve 20*a* and depending downwardly therefrom. An annular space 22 is formed between the grapple sleeve 20*a* on the one hand and the carrier member 16 and lower portion of the sub 14 on the other hand, and opposed axially facing shoulders 24 and 26 are formed on the grapple sleeve 20*a* and carrier 16 respectively at opposite ends of space 22. A compression spring 28 is disposed in the annular space 22 and bears against shoulders 24 and 26 to urge the grapple 20*a*, 20*b* upwardly with respect to the carrier 16. Such upward movement is limited by engagement of the upper end 20*c* of the grapple with the external annular shoulder 14*a* formed between the large and small diameter portions of sub 14. Thus the grapple is carried by the first assembly at its lower end while limited upward movement of the first assembly with respect to the grapple or downward movement of the grapple with respect to the first assembly is permitted by compression of the spring 28. However, this last movement is limited by engagement of a shoulder 25 formed by the upper edge of carrier 16 with shoulder 24.

The second or outer elongate assembly of the tool comprises an upper connector sub 34 which may be connected into a string of pipe and which slidingly receives the washpipe 10 of the first assembly. The washpipe 10 is sealed to the sub 34 by an O-ring 36. A sleeve 38 is threadedly connected to the sub 34 and extends downwardly therefrom in surrounding relationship to the upper parts of the first assembly.

A compression spring 70 received in the annular space between washpipe 10 and sleeve 38 bears against the lower end of the sub 34 and the upper end of sub 12 to bias the first and second elongate assemblies in a first directional mode of telescopic movement. In the embodiment of FIGS. 1A and 1B, the first mode includes downward movement of the first or inner assembly with respect to the second or outer assembly, and/or upward movement of the outer or second assembly with respect to the inner or first assembly. However, as will be made apparent subsequently, the first mode can be reversed by suitable re-arrangement of the parts of the tool.

A second cam member 40 is threadedly connected to the lower end of sleeve 38 and generally telescopically receives the main body portion 18*a* of the first cam member. Cam member 18*a*, 18*b*, 18*c* and cam member 40 together comprise the camming mechanism of the tool. A second sleeve 42 is threadedly connected to the lower end of second cam member 40 and extends downwardly therefrom. The lower portion 42*a* of sleeve 42 forms a bowl which serves as the deflecting means for the grapple fingers 20*b*. The sleeves 38 and 42 are sealed to the first assembly by O-rings 54 and 56 respectively.

Each of the grapple fingers 20*b* has a plurality of external downwardly and inwardly tapered surfaces 44 along its length separated by axially upwardly facing shoulders 46. The bowl 42*a* has a pluarality of matching internal downwardly and inwardly tapered surfaces 48 along its length separated by axially downwardly facing shoulders 50. The grapple fingers 20*b* are formed of spring metal biased radially outwardly. Thus it can be seen that upon downward movement of the bowl 42*a*, the engagement of shoulders 46 and 50 will cause the grapple to move downwardly also. However, upon upward movement of the bowl 42*a*, if the grapplle is retained in a fixed longitudinal position, the tapered surfaces 48 will, by their engagement with the the matching surfaces 44, urge the grapple fingers radially inwardly. The inner surfaces of the fingers 20*b* are serrated as at 52 to enable them to grip a fish surrounded by the fingers 20*b* when the latter are urged inwardly.

Referring now to FIGS. 6–11, the camming mechanism is shown in greater detail. Second cam member 40 is a sleevelike member whose lower end surfaces are machined to form a plurality of contiguous teeth 58 disposed circumferentially about the cam member 40. Each tooth 58 has one longitudinally extending side 58*a* and one longitudinally and circumferentially extending side 58*b*. Portion 18*b* of the first cam member has its upper end similarly machined to form a series of contiguous teeth 60 disposed circumferentially about the first cam member. Each tooth 60 has a longitudinally extending side 60*a* and a longitudinally and circumferentially extending side 60*b*. When the portion 18*b* of the first cam member is mounted on the main body portion 18*a* as shown, it forms a radially upset portion of the first cam member. The sides 60*b* of its teeth are configured to be complementary to sides 58*b* of teeth 58, e.g. as viewed in FIG. 6, both are inclined downwardly from left to right. Thus, teeth 60 can mesh with the teeth 58 as shown, for example, in FIG. 11. Although surfaces 58*b* and 60*b* preferably match perfectly as shown, the term "complementary," as used herein will simply mean inclined in the same general direction. Thus one of two complementary surfaces could be curved and the other straight; one could be shorter than the other, etc.

Figure 8:
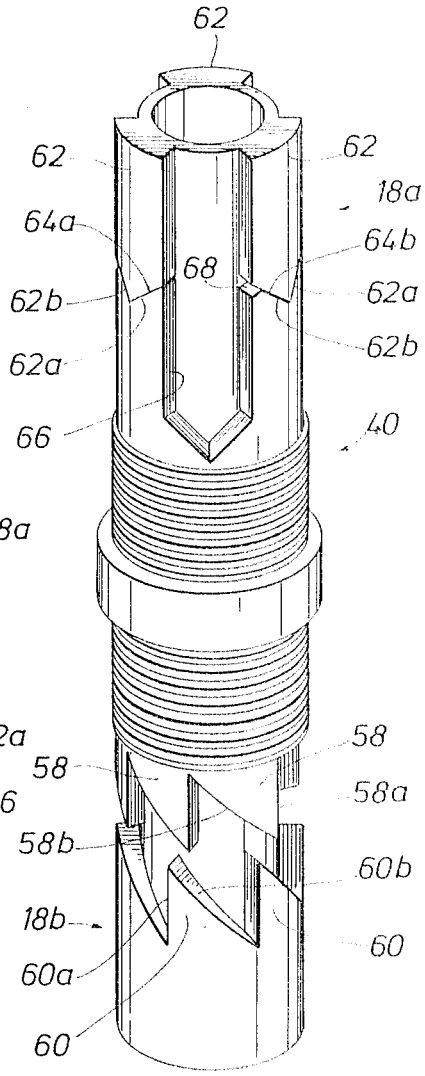
FIG. 8 is a perspective view of the camming assembly of the tool of FIGS. 1–7 in release position.
Figure 10:
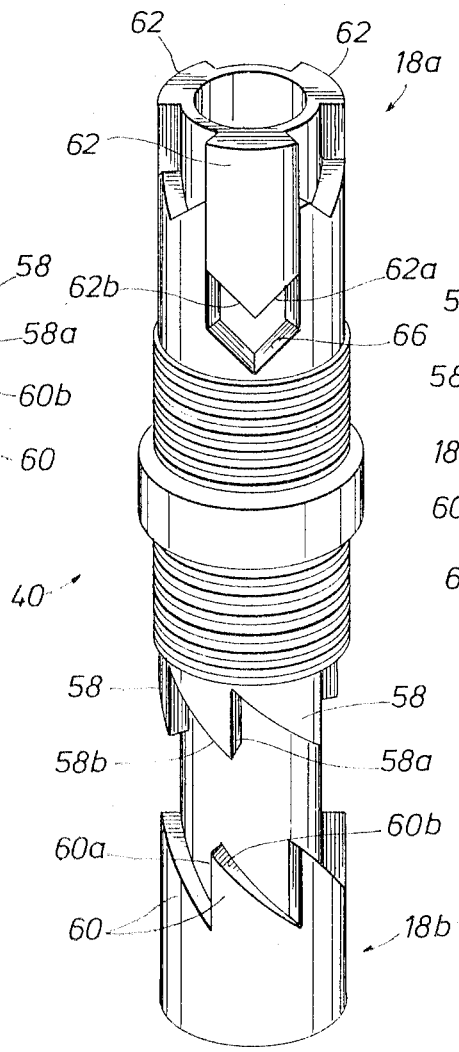
FIG. 10 is a view similar to those of FIGS. 8 and 9 showing the assembly in catch position.

Three other radially upset portions are formed at the upper end of cam member portion 18*a* to form three projections 62 extending downwardly from the upper end of portion 18*a* and circumferentially spaced thereabout. Each of the projections 62 has longitudinally extending side surfaces and a V-shaped end portion defined by converging surfaces 62*a* and 62*b*. The upper end surface of cam member 40 is machined to form three circumferentially spaced shallow notches. The shallow notches are V-shaped, being defined by converging sides 64*a* and 64*b*, and are sized and spaced so that each may receive the end portion of a respective one of the projections 62 as shown in FIG. 8. Interposed between the shallow notches, are three deep notches 66 each of which may receive a respective one of the projections 62 when the cam members are rotated to a different relative positions as shown in FIG. 10. Intermediate the side 64*b* of each of the shallow notches and the adjacent deep notch 66 is a surface 68 inclined circumferentially and longitudinally downwardly toward the notch 66.

Figure 6:
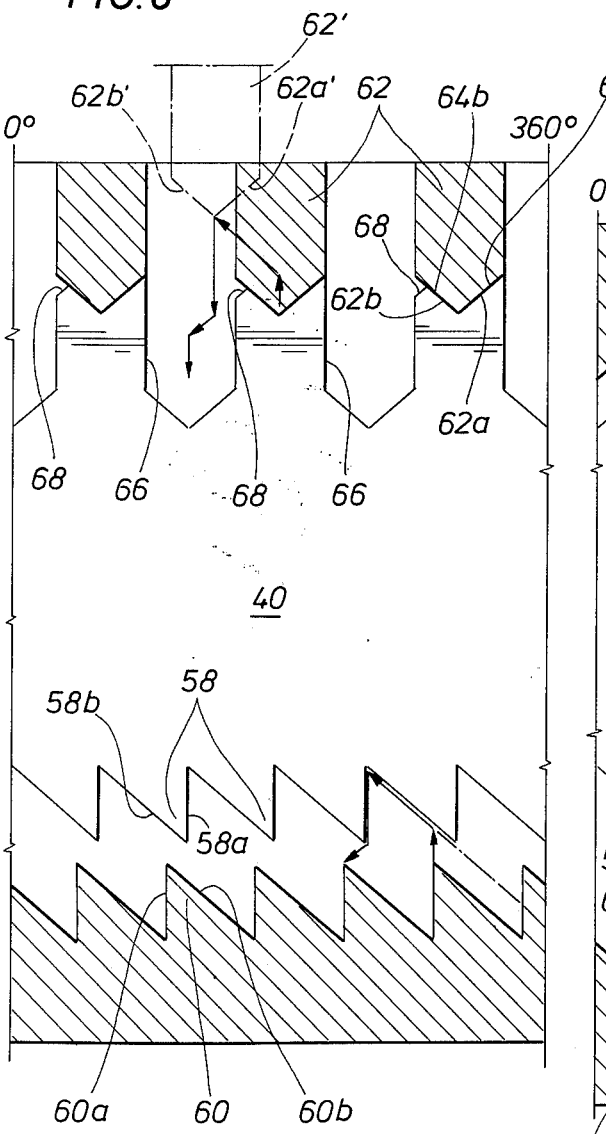
FIG. 6 is a developed view of the camming surfaces showing two relative positions.

Referring now to FIGS. 1A and 1B in conjunction with FIGS. 6 and 8, the overshot and its camming mechanism are shown in a running-in or release position. The end portions of the projections 62 are received in the shallow notches. The spring 70 urges the projections 62 downwardly into the shallow notches, i.e. in the first directional mode of telescopic movement described above, while the engaged surfaces 62*a*, 62*b*, and 64*a*, 64*b* of the projections and notches serve as stop surfaces to limit such movement. In this position, the grapple 20*a*, 20*b* is in its upper position in the bowl 42*a* with its upper end 20*c* in abutment with the shoulder 14*a*. The grapple fingers 20*b* are thus in their radially extended positon and shoulders 46 and 50 are in abutment.

In this release position, the tool is lowered into the well bore until the lower end of the carrier member 16 strikes or locates the fish to be retrieved. This abutment will prevent further downward movement of the first or inner assembly. Thus, upon the exertion of further downward force on the tool, the second or outer assembly will move downwardly with respect to the first or inner assembly. Such movement, as well as its functional equivalent of upward movement of the first assembly with respect to the second assembly, will be defined with respect to the present embodiment of the invention as the second directional mode of telescopic movement.

Upon such movement in the second mode, the cam member 40 moves downwardly with respect to the cam member 18*a*, 18*b* bringing the projections 62 out of the shallow notches. As best seen in FIG. 6, when the projections 62 are aligned with the shallow notches, the surfaces 58*b* of teeth 58 and the surfaces 60*b* of teeth 60 are partially aligned, i.e. opposed, and partially offset. Thus, upon downward movement of the member 40 from release position (solid lines in FIG. 6), surfaces 58*b* and 60*b* will be brought into engagement and, upon further downward movement of member 40, will act as first cam surfaces for their respective assemblies causing rotation of the first or inner assembly to the left as viewed in the drawings. Such rotation is arrested when the longitudinally extending sides 58*a* of teeth 58 strike the longitudinally extending sides 60*a* of teeth 60.

Meanwhile, the grapple 20*a*, 20*b* has been caused to move downwardly with the second assembly by virtue of the abutment of shoulders 46 and 50, such movement being permitted by the spring 28. The spring 28 is thus compressed and the upper end 20*c* of the grapple is separated from shoulder 14*a*. The tool is now in its first switching position shown in FIG. 4. Note that the fish 72 is surrounded by the grapple fingers 20*b* and the bowl 42*a*.

Figure 4:
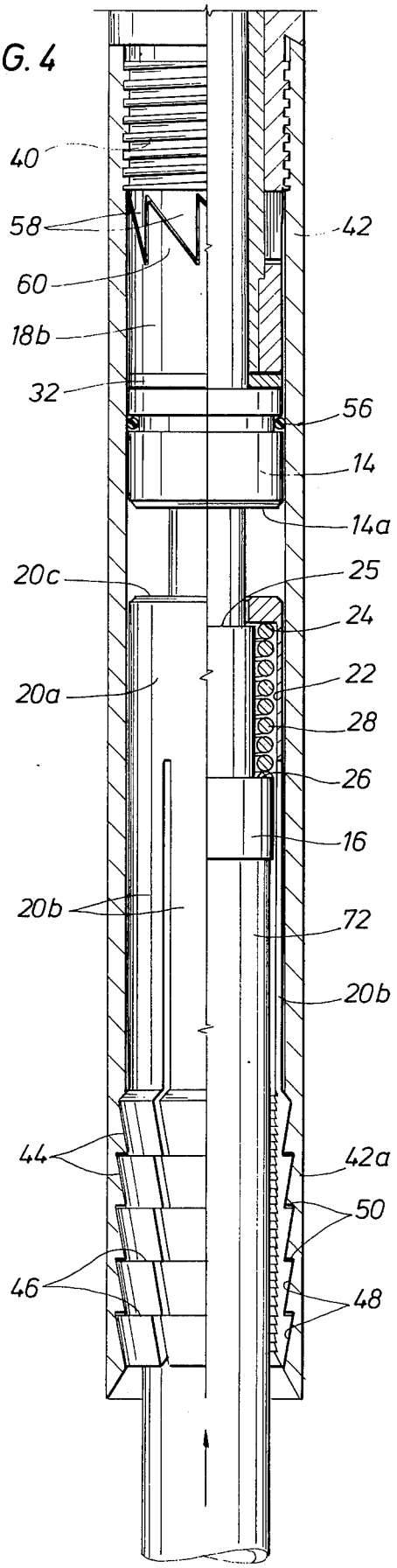
FIG. 4 is a view partly in longitudinal cross-section and partly in elevation of the lower portion of the tool of FIG. 1B in first switching position.
Figure 9:
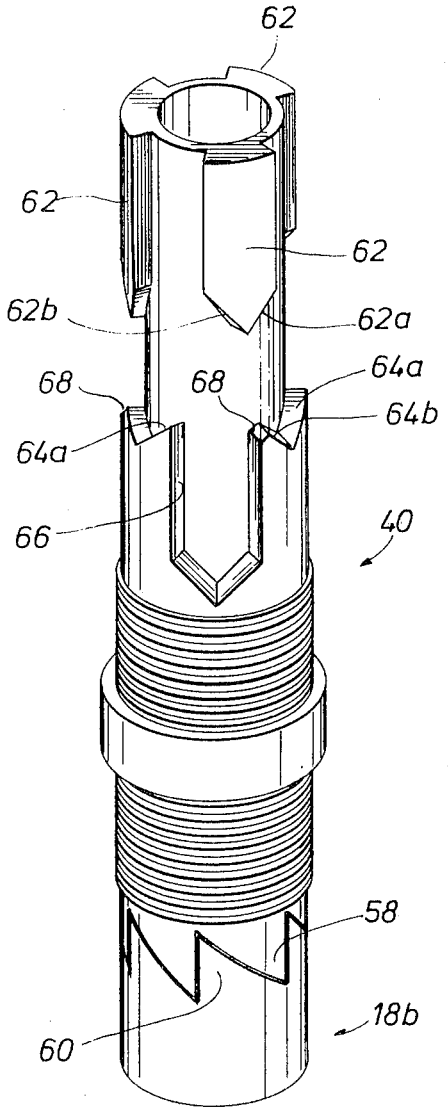
FIG. 9 is a view similar to that of FIG. 8 showing the camming assembly in first switching position.

The relative positions of the cam members in the first switching position is shown in FIGS. 4 and 9 and in phantom at 62′ in FIG. 6. It can be seen that the teeth 58 and 60 are meshed, that the projections 62 are free of either set of notches, and that the surface 62*a* of each projection 62 is aligned with or opposed to a respective one of the surfaces 68. The surfaces 62*a* and 68 serve as the second cam surfaces for the first and second assemblies respectively.

Figure 5:
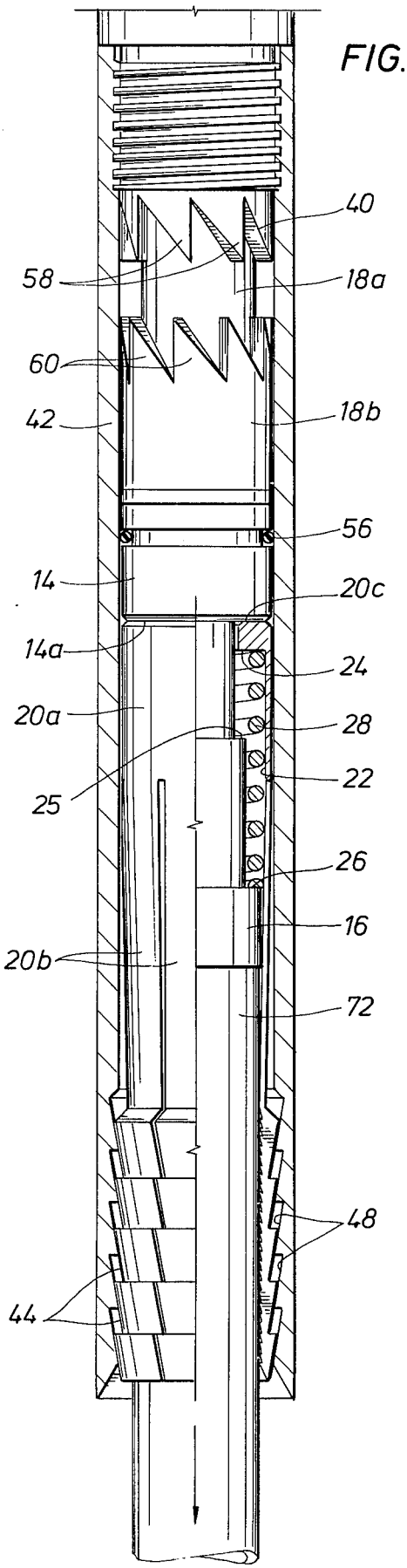
FIG. 5 is a view similar to that of FIG. 4 showing the tool in catch position.
Figure 11:
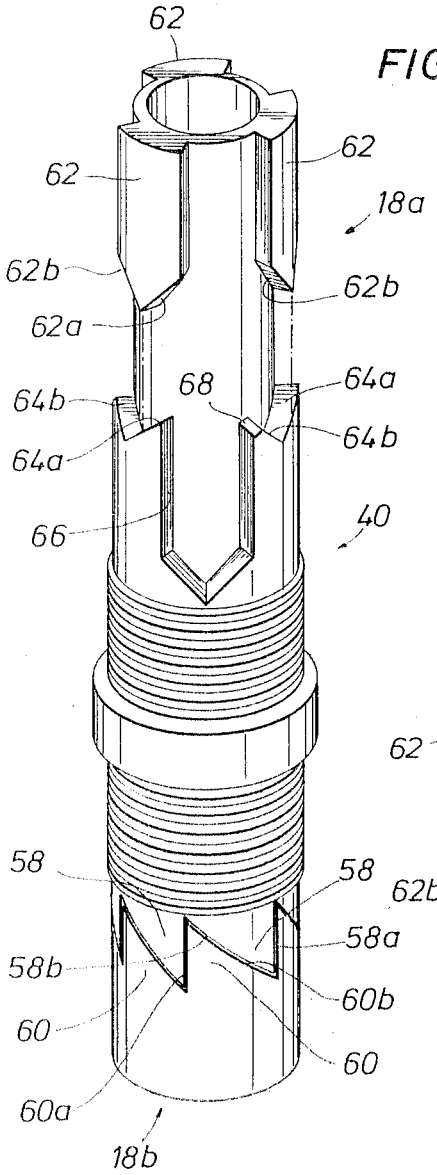
FIG. 11 is a view similar to those of FIGS. 8–10 showing the assembly in second switching position.

With the tool in its first switching position, an upward pull is exerted on the second or outer assembly. The inner or first assembly will be prevented from moving upwardly by virtue of its own weight as well as by the force of spring 70. Thus the first and second assemblies now move in their first telescopic mode. During such movement, the teeth 58 are raised out of engagement with the teeth 60. The second cam surfaces 68 of the second assembly then strike the second cam surfaces 62*a* of the first assembly whereupon further upward movement of the second assembly and its cam member 40 causes further rotation of the first assembly and its cam member 18*a*, 18*b* to the left bringing the projections 62 into alignment with the deep notches 66. Further upward movement of the second assembly, together with the force of spring 70 then carries the teeth 62 into the notches 66 as shown in FIG. 10 and in solid lines in FIG. 7. The tool is now in catch position (FIG. 5).

During the movement of the tool to catch position, the grapple 20*a*, 20*b* at first moves upwardly with the bowl 42*a*, allowing the spring 28 to expand, until the upper surface 20*c* of the grapple abuts shoulder 14*a*. Further upward movement of the grapple is now prevented so that, upon further upward movement of the bowl 42*a*, the fingers 20*b* are urged radially inwardly into gripping engagement with the fish 72 by the interengagement of surfaces 44 and 48. The fingers 20*b* are thus firmly wedged between the fish 72 and the bowl 42*a*. This wedging engagement of the grapple fingers 20*b*, when sufficiently tight, will prevent further telescopic movement of the first and second assemblies in their first directional mode. Therefore, continued exertion of an upward pull on the second or outer assembly will cause the entire tool as well as the engaged fish to be raised out of the well.

Figure 7:
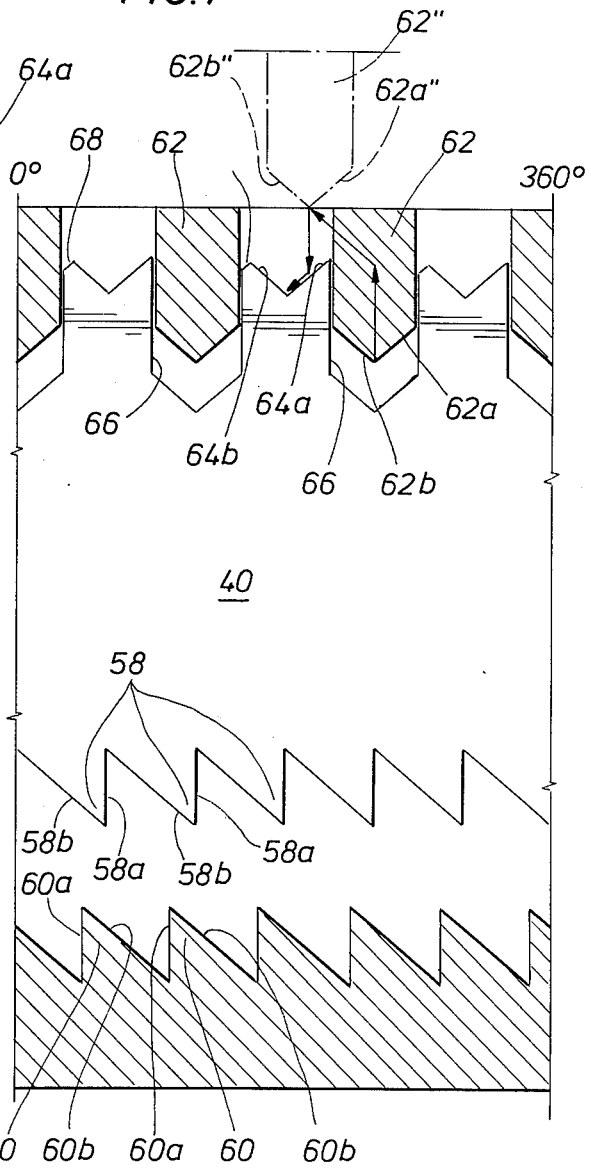
FIG. 7 is a view similar to that of FIG. 6 showing two other positions.

By comparison of FIGS. 7 and 10 it can be seen that the deep notches 66 are sized so that the end portions of the projections 62 are spaced from the bottoms of the notches 66 when the grapples 20*b* become wedged into gripping engagement with the fish. In other words, the projections 62 will never, under ordinary operating conditions, "bottom out" in the notches 66 and thus will not offer any limitations on the tightness with which fingers 20*b* can be wedged against the fish. As a safety precaution, the bottoms of the notches 66 may be formed with a V-shaped configuration complimentary to that of the end portions of the projections 62 as shown so as to avoid damage to the apexes of the projections if they should, for some unforseen reason, bottom out.

The grapple fingers 20*b* and bowl 42*a* are especially configured to grip a smooth-walled pipe or the like without the necessity for a collar or other abutment on the pipe for engagement with the grapple fingers. Accordingly, the serrations 52 extend along a substantial portion of the length of the grapple fingers. When the tool is in catch position and an upward pull is exerted to remove the tool and engaged fish from the well, lateral forces will be exerted on the bowl 42*a* due to the tapered surfaces 44 and 48. By providing a plurality of such tapered surfaces along the length of the fingers 20*b* and bowl 42*a*, these lateral forces are distributed over a large area so that a high upward pull can be exerted without damage to the tool by the lateral forces.

It has been found that in a typical prior art grapple having only one relatively short tapered surface on each of the fingers and a matching surface on the bowl, the bowl fractured upon submission to a longitudinal pull of 35,000 lb. By comparison, a grapple of like size having a plurality of tapered surfaces such as 44 and 48 has been tested under longitudinal forces of 60,000 lb. without any deformation of the bowl, and it is believed that even higher forces could be exerted without significant damage.

The release, first switching, and catch positions described above are the only positions which are absolutely necessary under normal operating conditions. However, the tool is preferably designed to return from the catch position to the release position via a second switching position so that, for example, if the fish should be lost, it can be once again retrieved without removing the tool from the well, or if the fish is too firmly stuck in the well, it can be released.

As best seen in FIG. 7, when the parts are in catch position, the surfaces **58*b* are partially opposed to and partially offset from the surfaces 60*b* in a manner similar to the release position (FIG. 6). If the fish is lost with the tool in this position, the tool may be lowered until the top of the fish strikes either the lower ends of the grapple fingers 20*b* or the lower end of the carrier 16**.

Then continued downward force on the outer or second assembly, will cause telescopic movement in the second mode. Deep notches 66 will be moved off of the projections 62 and the first cam surfaces **58*b* and 60*b* will be engaged and will cause further rotation of the inner assembly and its cam member 18*a*, 18*b* to the second switching position shown in FIG. 11 and by the phantom lines 62″ in FIG. 7. As best seen in FIG. 7, the second cam surfaces 62*a* (shown at 62*a*″) are, in this position, partially opposed to and partially offset from the surfaces 64*a* of respective ones of the shallow notches, the latter surfaces thus forming a third set of cam surfaces on the cam member 40. An upward force is now exerted on the second assembly to cause relative movement of the first and second assemblies in their first mode. Thus the teeth 58 and 60 will be moved out of engagement, and the second cam surfaces 62*a* will strike the third cam surfaces 64*a* causing rotation of the inner cam member 18*a*, 18*b* and moving the projections 62 into the shallow notches 64*a*, 64*b*, i.e. into release position. This last rotation is terminated at the proper point when the stop surfaces 62*b* strike the stop surfaces 64*b***. It is now possible to re-engage the fish by the same process as described above.

Figure 16:
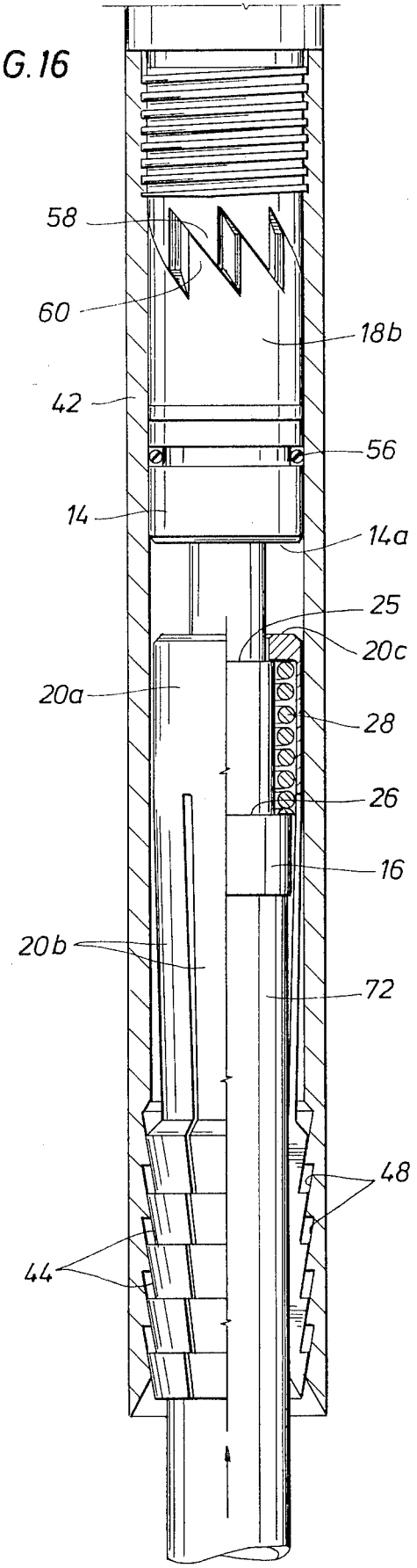
FIG. 16 is a view similar to those of FIGS. 4 and 5 showing the tool in an intermediate position.

A similar procedure can be used to release a fish which has been engaged if it is too firmly stuck in the well. However, when the downward force is exerted on the tool, the grapple **20*a*, 20*b* may tend to move downwardly with the outer assembly of the tool so that the fingers 20*b* remain in their radially inner position. If this should occur, such downward movement of the grapple 20*a*, 20*b* will be limited by abutment of the interengeable formations formed by shoulders 24 and 25. FIG. 16 shows the lower portion of the tool in such intermediate position, the grapple having moved downwardly with the bowl 42*a* and the shoulders 24 and 25 having become engaged. Upon the further exertion of downward force from this intermediate position, the bowl will move down with respect to the grapple 20*a*, 20*b* whereupon the fingers 20 will be permitted to move radially outwardly by virture of their own resilient biasing and return to the position shown in FIG. 1B**.

Each of the cam surfaces **60*b* and 62*a* of the first cam member 18*a*, 18*b* as well as each of the cam surfaces 58*b*, 64*a*, and 68 of the second cam member 40, extend both circumferentially and longitudinally and thus provide a substantial contact surface rather than point contact. Stop surfaces 62*a*, 62*b* and 64*a*, 64*b*, as well as rotation limiting surfaces 58*a* and 60*a*, also provide substantial surface contact area rather than point contact. Thus shearing and other types of damage are mitigated by the camming mechanism of the invention. This advantage is further enhanced by the fact that, in the second cam member 40, the cam surfaces are defined by the end surfaces of the cam member itself, and in the cam member 18*a*, 18*b***, the cam surfaces are defined by radially upset portions of substantial magnitude or extent with respect to the cam member as a whole. Thus there are no small relatively delicate cam parts such as pins which could be easily broken off.

Figure 12:
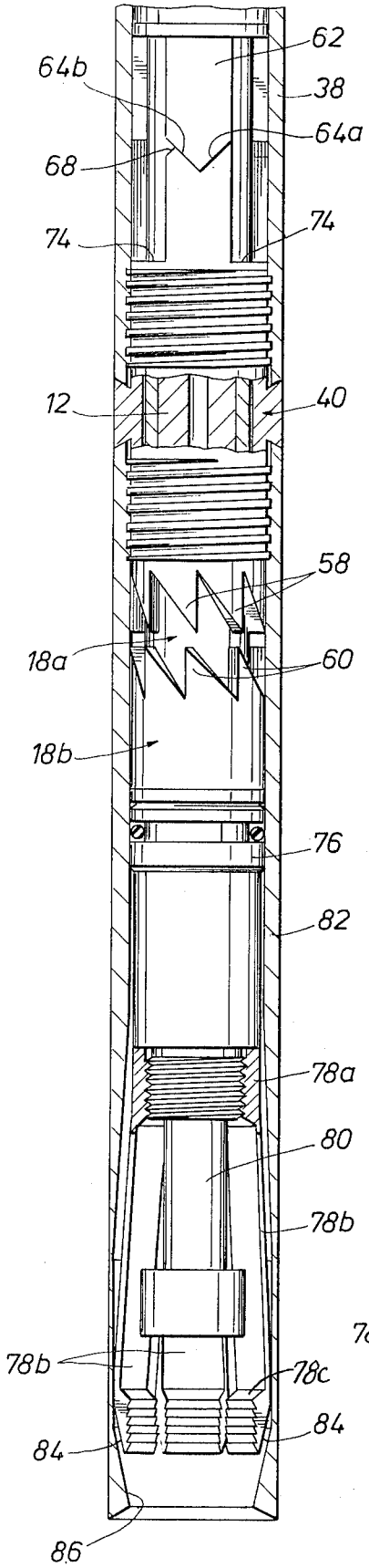
FIG. 12 is a view partly in longitudinal cross-section and partly in elevation of a second embodiment of overshot in release position.
Figure 13:
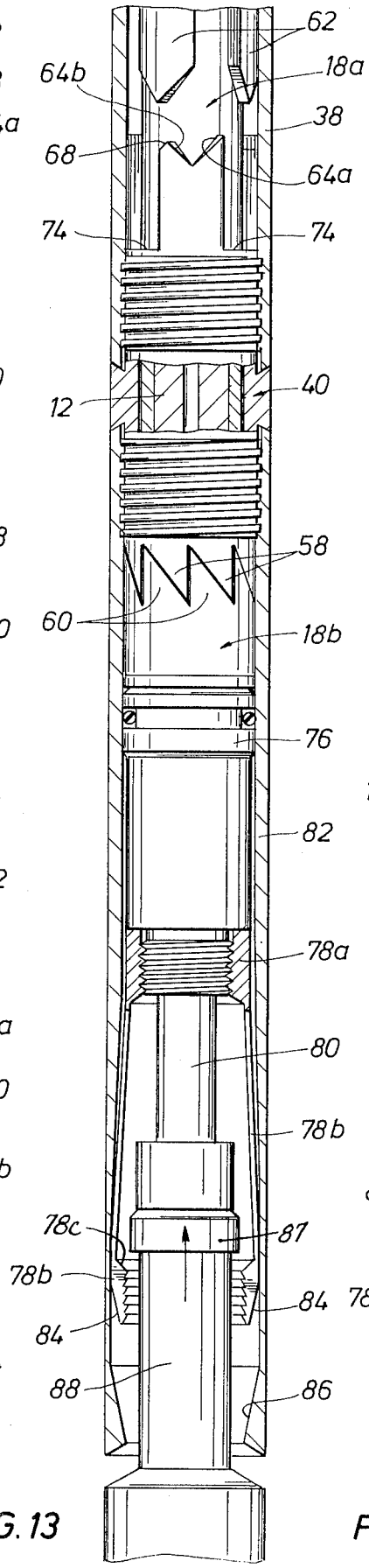
FIG. 13 is a view similar to that of FIG. 11 showing the tool in first switching position.
Figure 14:
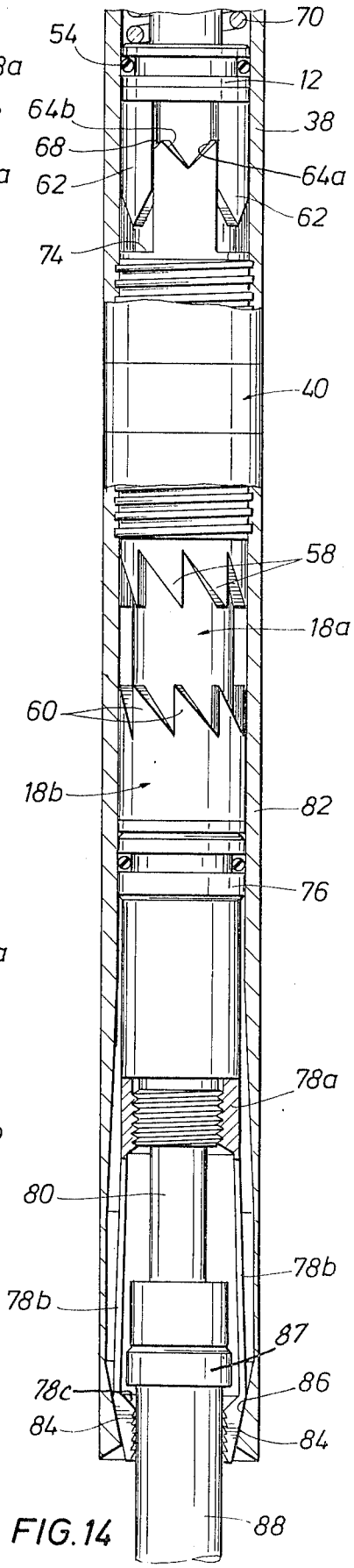
FIG. 14 is a view similar to those of FIGS. 11 and 12 showing the tool in catch position.

FIGS. 12–14 show a second embodiment of overshot. The upper portions of the tool (not shown) are identical to those of the tool of the preceding figures. The camming mechanism is also substantially identical to that of the preceding embodiment except for the deep notches 74, which are straight-bottomed. Accordingly, like parts of the tool have been given like reference numerals to those of the first embodiment.

The difference between the two overshots reside in the lower parts of the tool. Specifically, a sub 76 is threaded to the lower end of the sub 12 of the inner assembly. The grapple assembly includes a collar **78*a* threaded onto the lower end of the sub 76 and a plurality of fingers 78*b* extending downwardly from the collar. A locating member 80 threaded into the lower end of sub 76 extends downwardly among the fingers 78*b* to provide a means of abutment between the first assembly and the fish. The lower sleeve 82 of the second or outer assembly is threaded to the cam member 40 and its lower end forms a bowl for cooperation with the grapple fingers 78*b***.

The grapple fingers and bowl are of conventional design, the fingers **78*b* having internal upwardly directed shoulders 78*c* to enable the grapple to engage the fish 88 underneath a collar 87** or other abutment.

Each of the fingers **78*b* comprises a single outer downwardly and inwardly tapered surface 84. Similarly, the bowl comprises matching inner frusto-conical surface 86. Since there are no shoulders, such as 46 and 50 of the first embodiment, to limit downward movement of the bowl with respect to the grapple, there is no need to provide for relative longitudinal movement between the grapple and the first assembly by which it is carried. Thus the necessity for a spring such as 28** or other such means is eliminated.

FIG. 12 shows the tool in running-in or release position. In. FIG. 13, first switching position, the locator 80 has engaged the fish 88 and the second assembly has been urged downwardly with respect to the first assembly. The substantial longitudinal movement which is permitted between the grapple fingers **78*b* and the bowl 82 is clearly shown. FIG. 14 shows the catch position in which the surfaces 84 and 86 are engaged to wedge the grapple fingers 78 against the fish 88**. The operation of the other parts of the tool is substantially identical to that of the first embodiment.

Figure 15A:
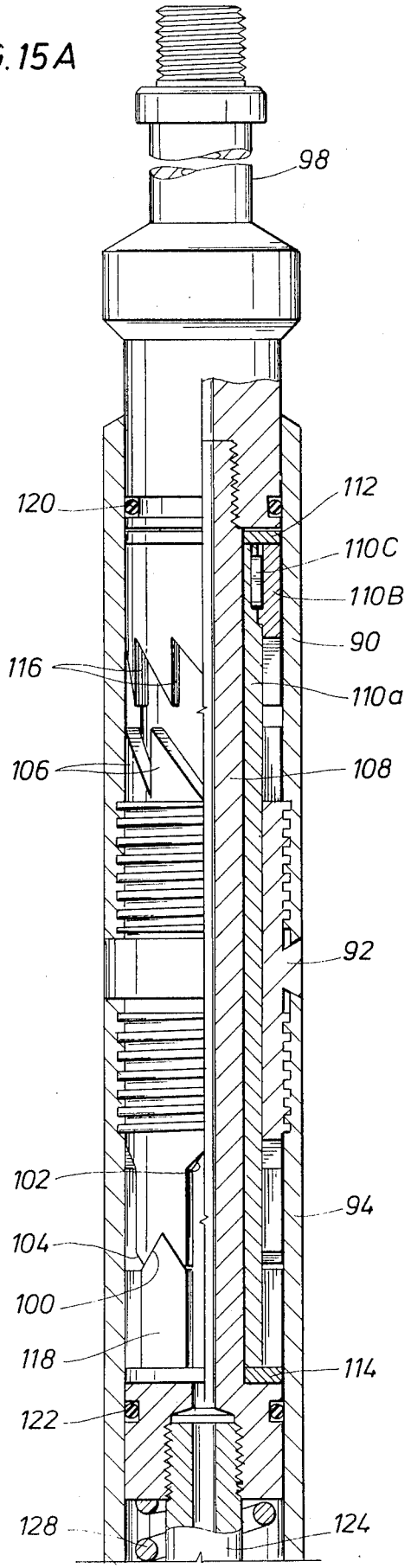
FIG. 15A is a view partly in longitudinal cross-section and partly in elevation of the upper portion of a spear according to the invention.
Figure 15B:
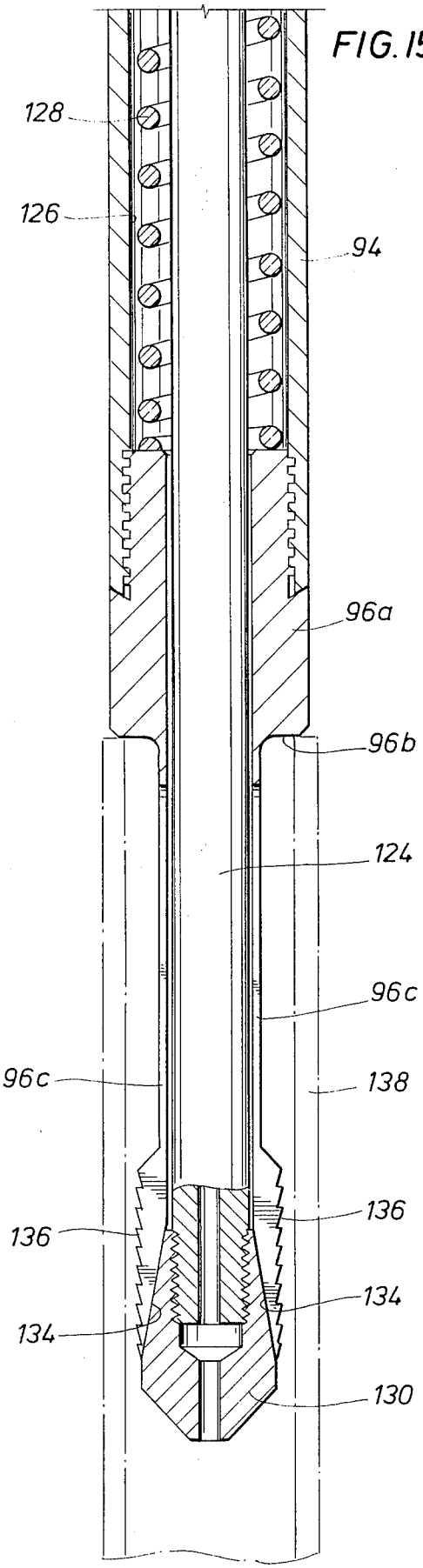
FIG. 15B is a view similar to that of FIG. 15A of the lower portion of the spear.

Turning now to FIGS. 15A and 15B, there is shown a spear. This type of tool is used to grip a large diameter conduit, such as a piece of severed casing, from the inside to retrieve it from the well. In this tool, the first of the two elongate assemblies is the outer assembly. It comprises an upper sleeve 90 threadedly connected to a first cam member 92 which is substantially identical to the cam member 40 of the preceding embodiments except that its position is reversed so that its teeth 106 extend upwardly and its shallow and deep notches 100 and 102 respectively open downwardly. A second sleeve 94 is threadedly connected to the lower end of cam member 92 and extends downwardly therefrom. The gripping means is threadedly connected to the lower end of the sleeve 94. The gripping means comprises an annular connector **96*a* having a generally large diameter upper portion and a reduced diameter lower portion defining an external downwardly directed shoulder 96*b* therebetween for locating the casing. A plurality of slips 96*c* extend downwardly from the connector 96*a*. The slips 96*c*** are biased radially inwardly but may be radially extended as will be explained more fully below.

The second or inner assembly of the tool comprises an upper sub 98 for connecting the tool to a pipe string or the like. A sub 108 having a reduced diameter upper portion and an enlarged lower portion is threadedly connected to the sub 98. A second cam member, comprising a main body portion **110*a* and a short annular portion 110*b* secured to portion 110*a* by a key 110*c*, surrounds the reduced diameter portion of the sub 108. An annular spacer 112 is disposed between the upper end of the cam member and the sub 98, and a similar spacer is disposed between the lower end of the cam member and the shoulder formed between the small and large diameter portions of sub 108. Cam member 110*a*, 110*b* is substantially identical to the cam member 18*a*, 18*b* of the first embodiment of the invention, except for its orientation. In particular, it includes downwardly directed teeth 116 substantially identical to teeth 60 and configured to mesh with teeth 106 on the first cam member, and upwardly extending projections 118 substantially identical to projections 62 and configured to be received in respective ones of the shallow notches 100 or in respective ones of the deep notches 102**.

Subs 98 and 108 are sealed to sleeves 90 and 94 respectively by respective O-rings 120 and 122. An expander carrier 124 is threadedly connected to the lower end of sub 108 and extends downwardly between the slips **96*c*. An annular space 128 is defined between the carrier 124 and the sleeve 94. A compression spring 128 is disposed in this space to bear against the lower end of sub 108 of the second assembly and the upper end of connector 96*a*** of the gripping means (connected to the first assembly) to urge or bias the two assemblies toward a first mode of telescopic movement which, in this case, includes upward movement of the inner or second assembly and/or downward movement of the outer or first assembly.

An expander 130 is threadedly connected to the lower end of the carrier 124. Expander 130 has an external frusto-conical surface 132 tapered upwardly and radially inwardly. Each of the slips **96*c* has a matching internal surface 134 also tapered upwardly and radially inwardly. Slips 96*c* also have serrated outer surfaces 136** for biting into the casing to be retrieved in order to grip the same.

FIGS. 15A and 15B show the tool in running-in or release position after the shoulder **96*b* has just come into abutment with the upper end of a piece of casing 138 to be retrieved. Slips 96*c* and expander 130 are thus disposed within the casing 138. A continued downward force exerted at this point will cause the second or inner assembly to move downwardly, i.e. in a second mode of telescopic movement, with respect to the first assembly, which cannot move downwardly due to its abutment with casing 138. The first cam surfaces of the two assemblies, defined by teeth 106 and 116** respectively, will cause the first or outer assembly to rotate bringing the tool to its first switching position.

An upward force is then exerted on the second or inner assembly. The tool will accordingly move in its first telescopic mode, augmented by the spring 128 whereupon the second cam surfaces 104 of the first assembly and the second cam surfaces defined by the projections 118 of the second assembly will further rotate the outer assembly guiding the projections 118 into the deep notches 102, i.e. the catch position. The expander 130 is thus permitted to move upwardly with respect to the slips **96*c*** wedging them between the expander and the casing. The casing can now be retrieved. If the casing should be lost, the tool can be passed through a second switching position to return to release position and repeat the gripping process.

The three embodiments of the present invention described above depict only some of the modifications which are possible within the scope of the present invention. Numerous other modifications are also possible. For example, the projections 62 and 118 are shown as having generally symmetrical V-shaped end portions. However, since only one of the surfaces defining the V is required for the camming function, the end portions of the projections could be asymmetrical, like teeth 58, and the receiving notches could be correspondingly configured.

Likewise, the first cam surfaces, rather than being defined by a series of identical asymmetrical teeth such as 58 or 60, could be defined by projections similar to 62 on one of the cam members and alternating deep and shallow notches on the other. In this situation, only some of the first cam surfaces on the member having the notches would be used in rotating the tool from release to first switching position, while alternating ones of the first cam surfaces would be used to rotate the tool from catch to second switching position.

While in the preferred embodiments, all of the cam surfaces on each of the cam members extends both axially and circumferentially to provide a substantial contact area, it would be possible for some of the cam surfaces to provide only point contact without presenting a danger of shearing off of the cam surface defining element. For example, the surfaces 68 could be eliminated and the surfaces **64*b* allowed to converge with the adjacent long side surfaces of the deep notches 66. In this case, the apexes formed by such convergence would constitute the second cam surfaces of the member 40**.

Other modifications might involve changes in the structure or operation of the gripping means.

It should also be noted that the camming mechanism per se can be advantageously employed in numerous other types of devices in which it is necessary to convert longitudinal movement to rotational movement in discreet steps. For example, it may be used in gas lift valves. While it is especially useful in connection with downhole tools of various types, its scope of application is even broader and it can in fact be used in virtually any type of device in which such conversion of motion is necessary or useful. Still other modifications could be made by those skilled in the art without departing from the spirit of the invention. It is thus intended that the scope of the invention be limited only by the claims which follow.

I claim:

1. A tool for retrieving an object from a well comprising:

first and second elongate assemblies connected for relative telescopic movement;

gripping means carried by said first assembly and comprising a plurality of radially extendable and retractable gripping elements;

deflecting means carried by said second assembly and engageable with said gripping means upon relative telescopic movement of said assemblies in a first directional mode for effecting radial movement of said gripping elements and disengageable upon relative telescopic movement of said assemblies in a second directional mode opposite to said first mode;

stop surfaces of limited circumferential extent on each of said assemblies, alignable and offsetable by relative rotation of said assemblies, and engageable when aligned to limit relative telescopic movement of said assemblies in said first mode and retain said assemblies in a release position;

respective first cam surfaces on each of said assemblies positioned with at least some of the first cam surfaces of said first assembly at least partially opposed to at least some of the first cam surfaces of said second assembly in said release position and to be operative, in said release position, upon relative telescopic movement of said assemblies in said second mode, to relatively rotate said assemblies to a first switching position in which said stop surfaces are at least partially offset;

and respective second cam surfaces on each of said assemblies positioned with the second cam surfaces of said first assembly at least partially opposed to the second cam surfaces of said second assembly in said first switching position and to be operative, in said first switching position, upon relative telescopic movement of said assemblies in said first mode, to relatively rotate said assemblies to a catch position in which said stop surfaces are fully offset;

at least some of the cam surfaces on each of said assemblies extending axially and circumferentially.

2. The tool of claim 1 wherein said first assembly includes a generally axially facing locator for engagement with the object to be retrieved.

3. The tool of claim 1 wherein said first cam surfaces are positioned with at least some of the first cam surfaces of said first assembly at least partially opposed to at least some of the first cam surfaces of said second assembly in said catch position and to be operative, in said catch position, upon relative telescopic movement of said assemblies in said second mode to relatively rotate said assemblies to a second switching position, one of said assemblies further comprising third cam surfaces positioned to be at least partially opposed to the second cam surfaces of the other of said assemblies in said second switching position and to be operative, in said second switching position, upon relative telescopic movement of said assemblies in said first mode, to relatively rotate said assemblies to said release position.

4. The tool of claim 1 wherein said first cam surfaces on said respective assemblies are complementarily axially and circumferentially extending.

5. The tool of claim 4 wherein said second cam surfaces on said respective assemblies are complementarily axially and circumferentially extending.

6. The tool of claim 5 wherein said third cam surfaces on said one assembly and said second cam surfaces on said other assembly are complementarily axially and circumferentially extending.

7. The tool of claim 3 wherein said second cam surfaces on said other of said assemblies and said third cam surfaces on said one of said assemblies comprise at least a part of said stop surfaces.

8. The tool of claim 7 wherein said other of said assemblies comprises a plurality of circumferentially spaced longitudinally extending projections having end portions defining said stop surfaces and said second cam surfaces of said other of said assemblies; and wherein said one of said assemblies has a plurality of circumferentially spaced shallow notches for receipt of said projections in said release position and defining said stop surfaces and said third cam surfaces of said one of said assemblies, said one of said assemblies further having a plurality of deep notches disposed between said shallow notches for receipt of said projections in said catch position, said second cam surfaces of said one of said assemblies being formed between said deep and shallow notches.

9. The tool of claim 8 wherein said shallow notches and the end portions of said projections are V-shaped.

10. The tool of claim 9 wherein the first cam surfaces of each of said assemblies are defined by a series of contiguous teeth disposed circumferentially about said assembly, each of said teeth having one longitudinally extending side and one longitudinally and circumferentially extending side.

11. The tool of claim 8 wherein said one of said assemblies includes a sleeve-like cam member having end surfaces defining the cam surfaces and stop surfaces of said one assembly and wherein said other of said assemblies includes a male cam member received in said sleeve-like cam member and having radially upset portions defining the cam surfaces and stop surfaces of said other assembly.

12. The tool of claim 1 wherein said gripping means and said deflecting means each have a respective radially and axially tapered surface, said tapered surfaces being engageable with each other to effect said radial movement of said gripping elements.

13. The tool of claim 12 wherein said gripping means and said deflecting means each have a plurality of such tapered surfaces longitudinally adjacent one another and separated by generally axially directed shoulders, the shoulders on said gripping means being engageable with the shoulders on said deflecting means to limit relative longitudinal movement of said gripping means with respect to said deflecting means in a first direction; said tool further comprising resilient means disposed between said first assembly and said gripping means and yieldable to permit movement of said first assembly with respect to said gripping means in said first direction.

14. The tool of claim 13 including interengageable formations on said first assembly and said gripping means for limiting movement of said gripping means with respect to said first assembly in a second direction opposite to said first direction.

15. The tool of claim 13 wherein said gripping means and said first assembly have engageable abutment means for limiting longitudinal movement of said gripping means relative to said first assembly in said first direction.

16. The tool of claim 12 being an overshot, said gripping elements being a plurality of radially outwardly biased grapple fingers, and said deflecting means being a bowl generally surrounding said grapple fingers.

17. The tool of claim 12 being a spear, said gripping elements being a plurality of radially inwardly biased slips, and said deflecting means comprising an expander receivable between said slips.

18. A camming mechanism for converting longitudinal movement to rotational movement in discreet increments, said assembly comprising:

first and second elongate members connected for relative telescopic movement;

stop surfaces of limited circumferential extent on each of said members alignable and offsetable by relative rotation of said members and engageable when aligned to limit relative telescopic movement of said members in a first directional mode and retain said members in a first position;

respective first cam surfaces on each of said members positioned with at least some of the first cam surfaces of said first member at least partially opposed to at least some of the first cam surfaces of said second member in said first position and to be operative, in said first position, upon relative telescopic movement of said members in a second directional mode opposite to said first mode to relatively rotate said members to a second position in which said stop surfaces are at least partially offset;

and respective second cam surfaces on each of said members positioned with the second cam surfaces of said first member at least partially opposed to the second cam surfaces of the second member in said second position and to be operative, in said second position, upon relative telescopic movement of said members in said first mode, to relatively rotate said members to a third position in which said stop surfaces are fully offset;

at least some of the cam surfaces on each of said assemblies extending axially and circumferentially.

19. The mechanism of claim 18 wherein said first cam surfaces are positioned with at least some of the first cam surfaces of said first member at least partially opposed to at least some of the first cam surfaces of said second member in said third position and to be operative, in said third position, upon relative telescopic movement of said members in said second mode to relatively rotate said members to a fourth position, one of said members further comprising third cam surfaces positioned to be at least partially opposed to the second cam surfaces of the other of said members in said fourth position and to be operative, in said fourth position, upon relative telescopic movement of said members in said first mode, to relatively rotate said assemblies to said first position.

20. The mechanism of claim 19 wherein said first cam surfaces on said respective members are complementarily axially and circumferentially extending.

21. The mechanism of claim 20 wherein said second cam surfaces on said respective members are complementarily axially and circumferentially extending.

22. The mechanism of claim 21 wherein said third cam surfaces on said one cam member and said second cam surfaces on said other cam member are complementarily axially and circumferentially extending.

23. The mechanism of claim 19 wherein said second cam surfaces on said other of said members and said third cam surfaces on said one of said members comprise at least a part of said stop surfaces.

24. The mechanism of claim 23 wherein said other of said members comprises a plurality of circumferentially spaced longitudinally extending projections having end portions defining said stop surfaces and said second cam surfaces of said other of said members; and wherein said one of said members has a plurality of circumferentially spaced shallow notches for receipt of said projections in said first position and defining said stop surfaces and said third cam surfaces of said one of said members, said one of said members further having a plurality of deep notches disposed between said shallow notches for receipt of said projections in said third position, said second cam surfaces of said one of said members being formed between said deep and shallow notches.

25. The assembly of claim 24 wherein said shallow notches and the end portions of said projections are V-shaped.

26. The assembly of claim 25 wherein the first cam surfaces of each of said members are defined by a series of contiguous teeth disposed circumferentially about said member, each of said teeth having one longitudinally extending side and one longitudinally and circumferentially extending side.

27. The assembly of claim 26 wherein said one cam member is a sleeve-like member having end surfaces defining its cam surfaces and stop surfaces and said other cam member is a male member received in said sleeve-like member having radially upset portions defining its cam surfaces and stop surfaces.

28. The tool of claim 1 further comprising biasing means cooperative between said first and second assemblies to urge said assemblies in said first mode.

* * * * *